US010408213B2

(12) United States Patent
Morozumi

(10) Patent No.: US 10,408,213 B2
(45) Date of Patent: Sep. 10, 2019

(54) ROTARY COMPRESSOR

(71) Applicant: FUJITSU GENERAL LIMITED, Kawasaki-shi, Kanagawa (JP)

(72) Inventor: Naoya Morozumi, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 156 days.

(21) Appl. No.: 15/347,631

(22) Filed: Nov. 9, 2016

(65) Prior Publication Data

US 2017/0130721 A1 May 11, 2017

(30) Foreign Application Priority Data

Nov. 11, 2015 (JP) ..... 2015-221594

(51) Int. Cl.
*F04C 29/00* (2006.01)
*F04C 18/356* (2006.01)
(Continued)

(52) U.S. Cl.
CPC ..... *F04C 29/0021* (2013.01); *F01C 21/007* (2013.01); *F04B 39/0044* (2013.01); *F04C 18/3562* (2013.01); *F04C 23/008* (2013.01); *F24F 1/12* (2013.01); *F04C 2210/26* (2013.01); *F04C 2230/604* (2013.01); *F04C 2240/30* (2013.01); *F04C 2240/804* (2013.01); *F04C 2270/12* (2013.01)

(58) Field of Classification Search
CPC ..... F04C 29/0021; F04C 18/3562; F04C 23/008; F04C 2230/604; F04C 2240/30; F04C 2270/12; F24F 1/12; F01C 21/007; F04D 29/66; F04D 29/668; F04D 29/60; F04B 39/0044
USPC ..... 417/360, 363
See application file for complete search history.

(56) References Cited

U.S. PATENT DOCUMENTS 5,306,121 A * 4/1994 Heflin ..... F04B 39/0044 248/638
6,336,794 B1 * 1/2002 Kim ..... F04B 39/0044 417/363
2014/0093414 A1 4/2014 Omura et al.

FOREIGN PATENT DOCUMENTS

CN 1116521 C 7/2003
CN 102374154 A 3/2012
(Continued)

OTHER PUBLICATIONS

Extended European Search Report issued in coresponding EP Patent Application No. 16197657.6, dated Mar. 7, 2017.
(Continued)

*Primary Examiner* — Philip E Stimpert
(74) *Attorney, Agent, or Firm* — McDermott Will & Emery LLP

(57) ABSTRACT

A rotary compressor including an attachment leg which is fixed to a bottom portion of a compressor housing and includes three locking holes which are locking holes to which three corresponding elastic supporting members, which support the compressor housing, are locked and which are disposed to be separated from each other in a circumferential direction on an outside in a radial direction of the compressor housing, in which, of the three locking holes, a distance of a first locking hole which is disposed closest to an accumulator from a housing center, is greater than a distance of each of the other two locking holes from the housing center.

4 Claims, 5 Drawing Sheets

(51) Int. Cl.

| | |
|---|---|
| ***F04C 23/00*** | (2006.01) |
| ***F01C 21/00*** | (2006.01) |
| ***F04B 39/00*** | (2006.01) |
| ***F24F 1/12*** | (2011.01) |

(56) References Cited

FOREIGN PATENT DOCUMENTS

| | | | |
|---|---|---|---|
| CN | 103711698 | A | 4/2014 |
| CN | 104963863 | A | 10/2015 |
| JP | 61-070180 | A | 4/1986 |
| JP | 2005-055106 | A | 3/2005 |
| JP | 2009-162120 | A | 7/2009 |
| JP | 2012-177335 | A | 9/2012 |
| JP | 2013-160206 | A | 8/2013 |
| JP | 2015-114030 | A | 6/2015 |

OTHER PUBLICATIONS

Japanese Office Action issued in corresponding Japanese Patent Application No. 2015-221594, dated Jan. 29, 2019, with English Translation.

Chinese Office Action issued in corresponding Chinese Patent Application No. 201610990775.7, dated Jan. 23, 2019, with English Translation.

* cited by examiner

ROTARY COMPRESSOR

CROSS-REFERENCE TO RELATED APPLICATION

This application is based upon and claims the benefit of priorities from Japanese Patent Application No. 2015-221594 filed on Nov. 11, 2015; the entire contents of which are incorporated herein by reference.

FIELD

The present invention relates to a rotary compressor (hereinafter, also referred to simply as a "compressor") which is used in an air conditioner, a refrigerating machine, or the like.

BACKGROUND

A vertical compressor which is used in an air conditioner is provided with a plurality of elastic supporting members such as rubber or coil-springs interposed between the compressor and a base plate of an outdoor unit with the aim of preventing vibrations of the compressor from being directly transmitted to the outdoor unit of the air conditioner. Specifically, one end of the elastic supporting member is fitted into a locking hole of an attachment leg which is fixed to a bottom portion of a compressor housing, and the other end of the elastic supporting member is installed on the base plate of the outdoor unit. By screwing a locking nut onto a male screw which is provided on the tip of a locking bolt which passes through the base plate, the elastic supporting member, and the locking hole of the attachment leg, the compressor is elastically supported on the base plate of the outdoor unit. The movement of the compressor in the vertical direction is restricted to a range of a gap between the elastic supporting member and the bottom end of the locking nut.

With the aim of rendering the attachment space of the compressor on the base plate of the outdoor unit as small as possible, the plurality of elastic supporting members (and the locking holes of the attachment legs) which support the compressor are concentric with the compressor housing, are disposed on the outside in the radial direction of the compressor housing so as to screw the locking nuts from above using a handled box wrench, and three of the elastic supporting members (and the locking holes of the attachment legs) are generally used with the aim of reducing the attachment space and the cost.

In the attachment structure of the compressor described above, with the aim of preventing the compressor from becoming inclined to an accumulator side due to the weight of the accumulator which is fixed to the side portion of the compressor housing, for example, JP-A-2009-162120 describes an attachment structure in which there are provided a plurality of attachment mechanisms including an attachment leg which is fixed to the compressor, a supporting portion which is provided on a frame to which the compressor is attached, and an elastic supporting member which is disposed between the supporting portion and the attachment leg. The attachment mechanisms include a plurality of types of attachment mechanisms in which the configuration of one or more of the attachment leg, the supporting portion, and the elastic supporting member differs from that of the other attachment mechanisms. Specifically, attachment structures are described in which a height direction spacer is inserted in a portion of the elastic supporting members, the hardness of a portion of the elastic supporting members is changed, the positions of the plurality of elastic supporting members are rendered at an unequal pitch, or the like.

In recent years, technology is improving, and compressors have a tendency toward increased intake capacities while maintaining an equal size and mass of a compressor housing. However, if the intake capacity is increased, the compression load increases proportionally. Therefore, fluctuations in compression torque in a single rotation of a piston also increase proportionally. Accordingly, if the mass of the entire compressor is equal, since the fluctuation in compression torque to mass is increased, the vibration in the rotation direction centered on the housing center of the compressor housing increases.

In a state in which the compressor is installed in the outdoor unit of the air conditioner, the compressor is supported by not only the plurality of elastic supporting members, but also inlet-side piping and discharge-side piping which are connected to the compressor. Accordingly, if the vibration of the compressor increases, in a case in which the compressor is installed in the outdoor unit, there are problems in that the vibration of the piping which is connected to the compressor increases, the piping comes into contact with the housing of the outdoor unit and becomes a cause of noise, and further, that the piping stress exceeds a permitted value and the piping breaks.

Of the piping which is connected to the compressor, since the volumetric flow rate of refrigerant flowing inside the inlet-side piping is greater than that of the discharge-side piping, it is necessary to increase the diameter of the inlet-side piping. However, if the diameter is large, since the rigidity increases and it becomes difficult to absorb the vibration with the piping itself, there is a problem in that the vibration which is transmitted to the inlet-side piping, in particular, increases.

In JP-A-2009-162120, although a solution to the inclination of the compressor is proposed, there is no description of suppressing the vibration caused by fluctuation in the torque of the compressor. Bestowing rigidity on the elastic supporting member which supports the compressor using a method such as increasing the hardness of the elastic supporting member and attaching the compressor to the base plate of the outdoor unit are proposed with the aim of suppressing the inclination of the compressor. According to this method, an effect of suppressing the vibration amplitude of the compressor may be obtained. However, with this method, there are problems in that the vibration is more easily transmitted to the base plate of the outdoor unit, and the noise caused by the vibration of the base plate increases.

SUMMARY

An object of the present invention is to obtain a rotary compressor in which vibration caused by fluctuation in the torque of the compressor is suppressed, and it is possible to suppress the vibration of piping which is connected to the compressor and the vibration of a base plate of an outdoor unit to which the compressor is attached.

The present invention relates to a rotary compressor including a sealed vertically-placed cylindrical compressor housing which is provided with a discharging unit of a refrigerant on a top portion and which is provided with an inlet unit of the refrigerant on a bottom portion, a rotary-type compressing unit which is disposed on the bottom portion of the compressor housing, compresses the refrigerant which is sucked in from the inlet portion, and discharges the refrigerant from the discharging unit, a motor which is disposed on the top portion of the compressor housing and drives the rotary-type compressor, a vertically-placed cylindrical accumulator which is fixed to a side portion of the compressor housing and is connected to the inlet portion, and an attachment leg which is fixed to the bottom portion of the compressor housing and includes three locking holes which are locking holes to which three corresponding elastic supporting members, which support the compressor housing, are locked and which are disposed to be separated from each other in a circumferential direction on an outside in a radial direction of the compressor housing, in which, of the three locking holes, a distance of a first locking hole which is disposed closest to the accumulator from a housing center, is greater than a distance of each of the other two locking holes from the housing center.

In a rotary compressor according to the present invention, vibration caused by fluctuation in the torque of the compressor is suppressed, and it is possible to suppress the vibration of piping which is connected to the compressor and the vibration of a base plate of an outdoor unit to which the compressor is attached.

DESCRIPTION OF EMBODIMENTS

Hereafter, detailed description will be given of embodiments (examples) for realizing the present invention with reference to the drawings.

Example 1

Figure 1:
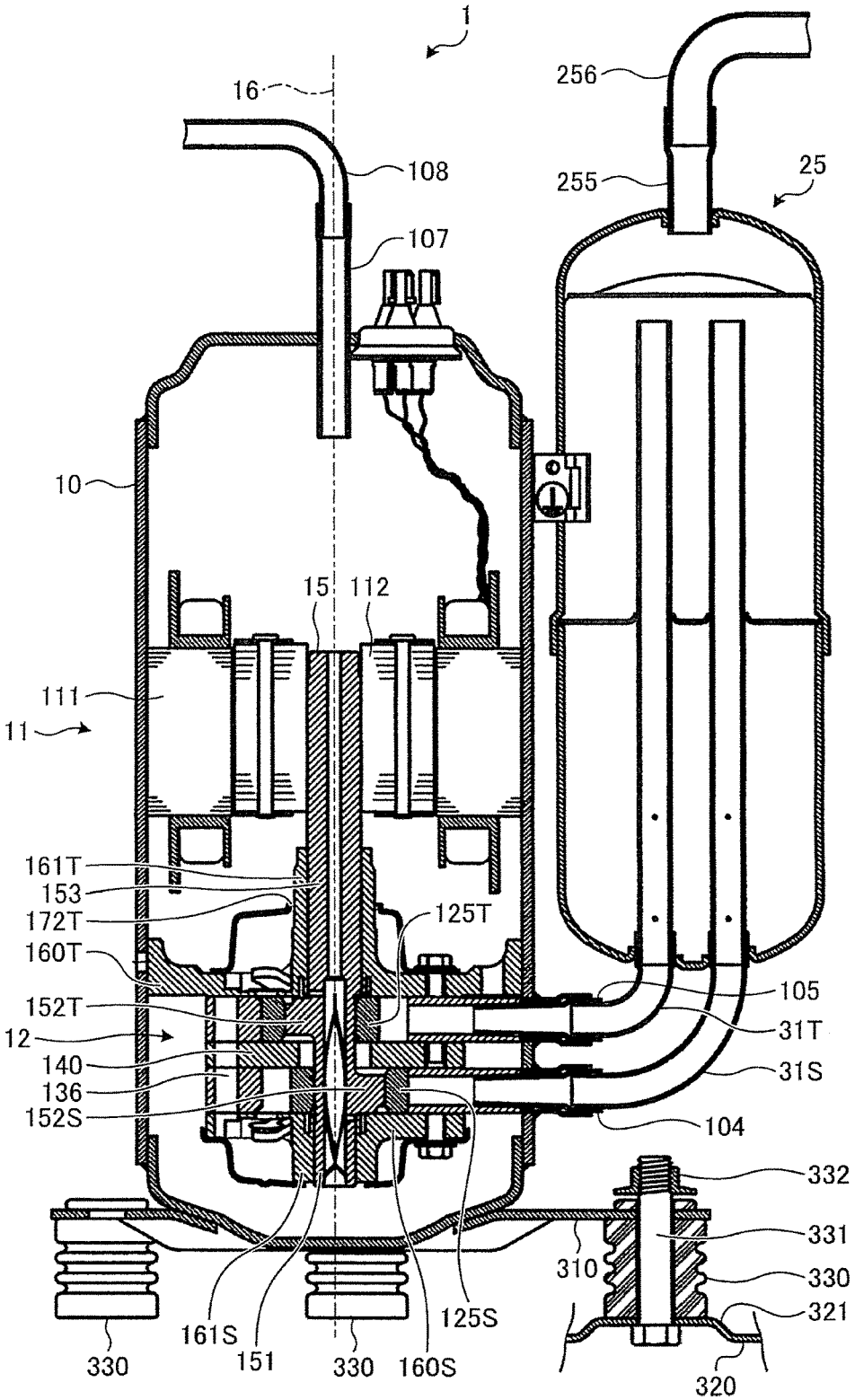
FIG. 1 is a vertical sectional diagram illustrating example 1 of a rotary compressor according to the present invention.
Figure 2:
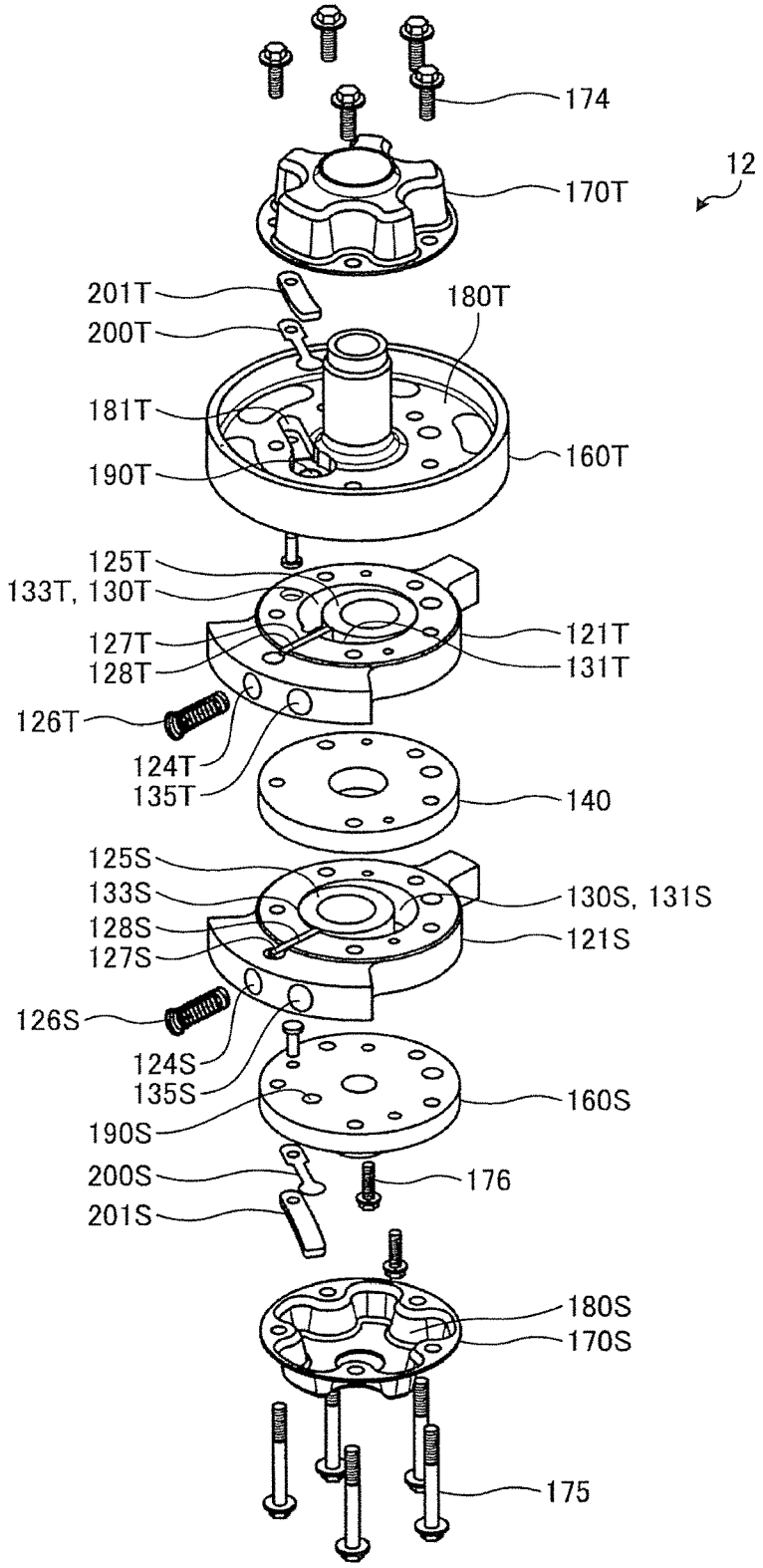
FIG. 2 is an exploded perspective diagram of a compressing unit (excluding a rotation shaft) of example 1, as viewed from above.

FIG. 1 is a vertical sectional diagram illustrating example 1 of a rotary compressor according to the present invention. FIG. 2 is an exploded perspective diagram of a compressing unit (excluding a rotation shaft) of example 1, as viewed from above.

As illustrated in FIG. 1, a rotary compressor 1 is provided with a rotary-type compressing unit 12, a motor 11, a vertically-placed cylindrical accumulator 25, and a housing base 310 (an attachment leg). The compressing unit 12 is disposed on the bottom portion inside a sealed vertically-placed cylindrical compressor housing 10, the motor 11 is disposed above the compressing unit 12 and drives the compressing unit 12 via a rotation shaft 15, the accumulator 25 is fixed to the side surface of the compressor housing 10 and an inner portion of the accumulator 25 is connected to a lower inlet chamber 131S of a lower cylinder 121S and an upper inlet chamber 131T of an upper cylinder 121T via a lower inlet pipe 104, an accumulator lower L-pipe 31S, an upper inlet pipe 105, and an accumulator upper L-pipe 31T, the housing base 310 is fixed to the bottom portion of the compressor housing 10, a plurality of elastic supporting members 330 are locked to the housing base 310, and the housing base 310 supports the entire rotary compressor 1.

A discharge pipe 107 (a discharging unit) for discharging a refrigerant to a refrigerant circuit (a refrigeration cycle) of an air conditioner by penetrating the compressor housing 10 is provided in the center of the top portion of the compressor housing 10. An accumulator inlet pipe 255 for sucking in the refrigerant from the refrigerant circuit (the refrigeration cycle) of the air conditioner by penetrating the housing of the accumulator 25 is provided in the center of the top portion of the accumulator 25.

The motor 11 is provided with a stator 111 on the outside, and a rotor 112 on the inside. The stator 111 is fixed by shrink-fitting to the inner circumferential surface of the compressor housing 10, and the rotor 112 is fixed by shrink-fitting to the rotation shaft 15 of the compressing unit 12.

In the rotation shaft 15, a main shaft unit 153 which is above an upper eccentric portion 152T is fitted, in a free-rotating manner, into a main-bearing unit 161T which is provided on an upper endplate 160T, a sub-shaft unit 151 which is below a lower eccentric portion 152S is fitted, in a free-rotating manner, into a sub-bearing unit 161S which is provided on a lower end plate 160S, and the lower eccentric portion 152S and the upper eccentric portion 152T are fitted, in a free-rotating manner, to a lower piston 125S and an upper piston 125T, respectively. Accordingly, the rotation shaft 15 is supported to rotate freely in relation to the entire rotary-type compressing unit 12, and by rotating, the rotation shaft 15 causes the lower piston 125S and the upper piston 125T to revolve.

As illustrated in FIG. 2, the compressing unit 12 is configured by stacking, in order from top, an upper end plate cover 170T, the upper end plate 160T, the upper cylinder 121T, an intermediate partition plate 140, the lower cylinder 121S, the lower end plate 160S, and a lower end plate cover 170S. The entire compressing unit 12 is fixed, from top and bottom, by a plurality of penetrating bolts 174 and 175 and auxiliary bolts 176 which are disposed in a substantially concentric manner.

A lower inlet hole 135S which mates with the lower inlet pipe 104 is provided in the lower cylinder 121S. An upper inlet hole 135 which mates with the upper inlet pipe 105 is provided in the upper cylinder 121T. The lower piston 125S is disposed in a lower cylinder chamber 130S of the lower cylinder 121S. The upper piston 125T is disposed in an upper cylinder chamber 130T of the upper cylinder 121T.

A lower vane groove 128S which extends from the lower cylinder chamber 130S to the outside in a radial manner is provided in the lower cylinder 121S, and a lower vane 127S is disposed in the lower vane groove 128S. An upper vane groove 128T which extends from the upper cylinder chamber 130T to the outside in a radial manner is provided in the upper cylinder 121T, and an upper vane 127T is provided in the upper vane groove 128T.

A lower spring hole 124S is provided in the lower cylinder 121S in a position which overlaps the lower vane groove 128S from the outside surface at a depth which does not penetrate the lower cylinder chamber 130S, and a lower spring 126S is disposed in the lower spring hole 124S. An upper spring hole 124T is provided in the upper cylinder 121T in a position which overlaps the upper vane groove 128T from the outside surface at a depth which does not penetrate the upper cylinder chamber 130T, and an upper spring 126T is disposed in the upper spring hole 124T.

The top and bottom of the lower cylinder chamber 130S are blocked by the intermediate partition plate 140 and the lower end plate 160S, respectively. The top and bottom of the upper cylinder chamber 130T are blocked by the upper end plate 160T and the intermediate partition plate 140, respectively.

Due to the lower vane 127S being caused to abut the outer wall of the lower piston 125S by the lower spring 126S, the lower cylinder chamber 130S is partitioned into the lower inlet chamber 131S which communicates with the lower inlet hole 135S, and a lower compression chamber 133S which communicates with a lower discharge hole 190S which is provided in the lower end plate 160S. Due to the upper vane 127T being caused to abut the outer wall of the upper piston 125T by the upper spring 126T, the upper cylinder chamber 130T is partitioned into the upper inlet chamber 131T which communicates with the upper inlet hole 135T, and an upper compression chamber 133T which communicates with an upper discharge hole 190T which is provided in the upper end plate 160T.

A lower end plate cover chamber 180S is formed on the exit side of the lower discharge hole 190S between the lower end plate 160S and the lower end plate cover 170S, which are fixed to each other in close contact. The lower endplate cover chamber 180S is provided with a concave portion (not illustrated) in the lower end plate 160S. A lower discharge valve 200S which prevents the refrigerant from backflowing in the lower discharge hole 190S and flowing into the lower compression chamber 133S, and a lower discharge valve cap 201S which restricts the opening degree of the lower discharge valve 200S are accommodated by the concave portion.

An upper end plate cover chamber 180T is formed on the exit side of the upper discharge hole 190T between the upper end plate 160T and the upper end plate cover 170T, which are fixed to each other in close contact. The upper endplate cover chamber 180T is provided with a concave portion 181T in the upper end plate 160T. An upper discharge valve 200T which prevents the refrigerant from backflowing in the upper discharge hole 190T and flowing into the upper compression chamber 133T, and an upper discharge valve cap 201T which restricts the opening degree of the upper discharge valve 200T are accommodated by the concave portion 181T.

Next, description will be given of the flow of the refrigerant caused by the rotation of the rotation shaft 15. Inside the lower cylinder chamber 130S and inside the upper cylinder chamber 130T, the lower piston 125S and the upper piston 125T which are respectively mated with the lower eccentric portion 152S and the upper eccentric portion 152T of the rotation shaft 15 revolve along the inner walls of the lower cylinder chamber 130S and the upper cylinder chamber 130T, respectively, due to the rotation of the rotation shaft 15. Accordingly, the lower inlet chamber 131S and the upper inlet chamber 131T suck in the refrigerant from the lower inlet pipe 104 and the upper inlet pipe 105, respectively, via the accumulator 25 while increasing in volume.

The lower compression chamber 133S and the upper compression chamber 133T compress the refrigerant while reducing in volume, and the pressure of the compressed refrigerant becomes higher than the pressure of the lower end plate cover chamber 180S and the upper end plate cover chamber 180T of the outside of the lower discharge valve 200S and the upper discharge valve 200T, respectively. Therefore, the lower discharge valve 200S and the upper discharge valve 200T open, and the refrigerant is discharged from the lower compression chamber 133S and the upper compression chamber 133T to the lower end plate cover chamber 180S and the upper end plate cover chamber 180T, respectively.

The refrigerant which is discharged to the lower end plate cover chamber 180S passes through a refrigerant path hole 136 (refer to FIG. 1) and the upper end plate cover chamber 180T, and is discharged from an upper end plate cover discharge hole 172T (refer to FIG. 1) into the inner portion of the compressor housing 10. The refrigerant which is discharged to the upper end plate cover chamber 180T is discharged from the upper end plate cover discharge hole 172T into the inner portion of the compressor housing 10.

The refrigerant which is discharged into the inner portion of the compressor housing 10 passes through a top-bottom communicating notch (not illustrated) which is provided in the outer circumference of the stator 111, a gap (not illustrated) in the winding portion of the stator 111, or a gap between the stator 111 and the rotor 112, is guided to above the motor 11, and is discharged from the discharge pipe 107 of the top portion of the compressor housing 10.

Figure 3:
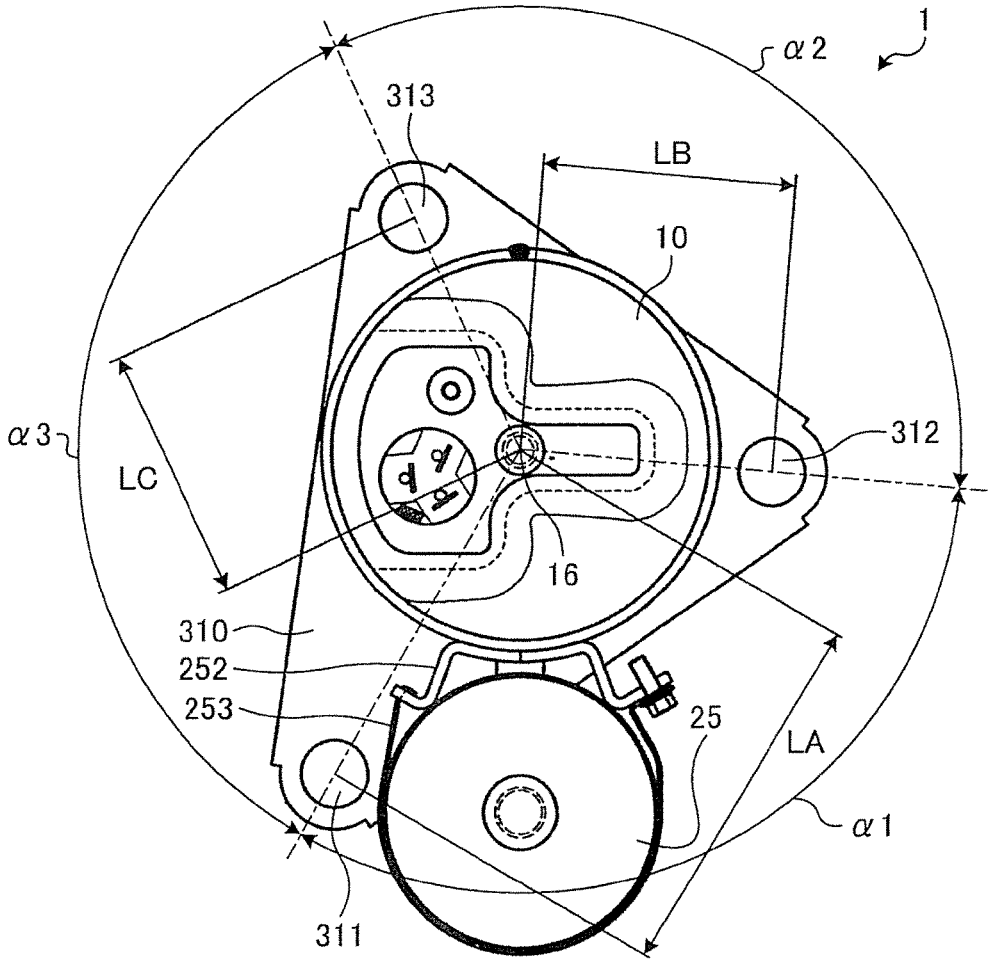
FIG. 3 is a top view illustrating example 1 of the rotary compressor according to the present invention.

Next, description will be given of the characteristic configuration of the rotary compressor 1 of example 1, with reference to FIGS. 1 and 3. As illustrated in FIGS. 1 and 3, the triangular plate shaped housing base 310 which serves as the attachment legs is fixed to the bottom end of the compressor housing 10 so as to orthogonally intersect a housing center line 16 (refer to FIG. 1). A first locking hole 311, a second locking hole 312, and a third locking hole 313 are provided in the housing base 310, one to each corner portion of the triangle shape. Instead of the triangular plate shaped housing base 310, three attachment legs may be adopted as the attachment legs (310), one end of each being fixed to the bottom portion of the compressor housing 10, and each of the other ends extend radially to the position of a corresponding one of the first locking hole 311, the second locking hole 312, and the third locking hole 313.

A distance LA from the housing center line 16 to the first locking hole 311 which is disposed closest to the accumulator 25 is greater than a distance LB from the housing center line 16 to the second locking hole 312, and is greater than a distance LC from the housing center line 16 to the third locking hole 313. A pitch angle $\alpha 1$ between the first locking hole 311 and the second locking hole 312, a pitch angle $\alpha 2$ between the second locking hole 312 and the third locking hole 313, and a pitch angle $\alpha 3$ between the third locking hole 313 and the first locking hole 311 are approximately equal.

A small-diameter portion of the top portion of each of the elastic supporting members 330 is mated with one of the first locking hole 311, the second locking hole 312, and the third locking hole 313. The bottoms of each of the elastic supporting members 330 are disposed on three supporting portions 321 which are provided on a base plate 320 of the outdoor unit of the air conditioner so as to correspond to the first locking hole 311, the second locking hole 312, and the third locking hole 313. A locking bolt 331 which is fixed (welded) to each of the supporting portions 321 passes through the corresponding elastic supporting member 330, and the corresponding one of the first, second, and third locking holes 311, 312, and 313, a locking nut 332 is screwed onto a screw portion on the tip of the locking bolt 331, and the first, second, and third locking holes 311, 312, and 313 are fastened to the corresponding supporting portions 321 via the elastic supporting members 330.

The first locking hole 311 may be disposed in a position no closer to the outside in the radial direction than the accumulator 25. According to this structure, the size of the installation space of the housing base 310 in the outdoor unit is not increased.

The first locking hole 311 may be disposed in a position which does not overlap the accumulator 25 as viewed from above. According to this structure, when lowering a socket wrench of a screw fastener from above and screwing the locking nut 332 onto the screw portion of the tip of the locking bolt 331, the socket wrench does not interfere with the accumulator 25.

Figure 5:
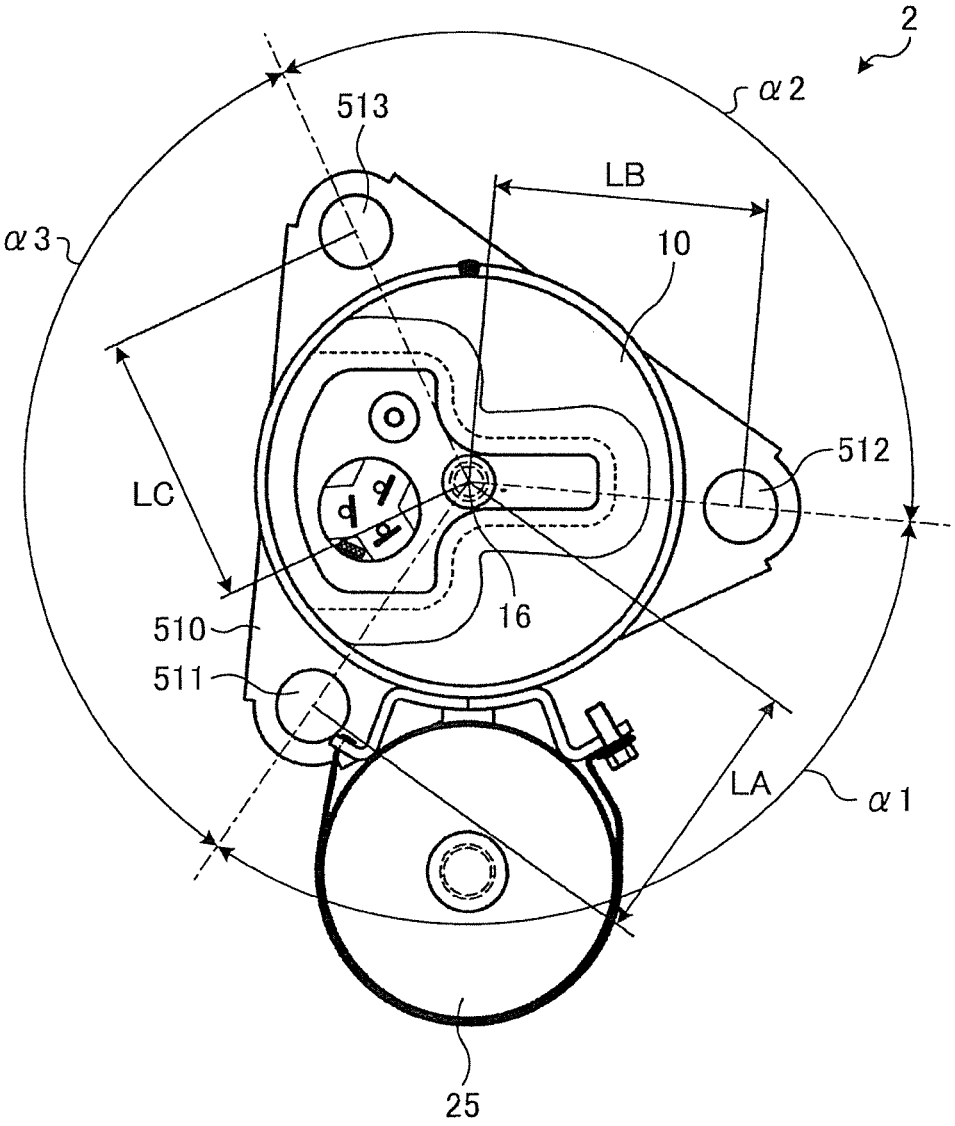
FIG. 5 is a top view illustrating a rotary compressor of the related art.

FIG. 5 is a top view illustrating a rotary compressor of the related art. As illustrated in FIG. 5, in a housing base 510 of a rotary compressor 2 of the related art, the distance LA from the housing center line 16 to a first locking hole 511 which is disposed closest to the accumulator 25 is equal to the distance LB from the housing center line 16 to a second locking hole 512, and is equal to the distance LC from the housing center line 16 to a third locking hole 513. The pitch angle $\alpha 1$ between the first locking hole 511 and the second locking hole 512, the pitch angle $\alpha 2$ between the second locking hole 512 and the third locking hole 513, and the pitch angle $\alpha 3$ between the third locking hole 513 and the first locking hole 511 are equal.

In the rotary compressor 1 of example 1, the distance LA from the housing center line 16 to the first locking hole 311 which is disposed closest to the accumulator 25 is rendered greater than the distance LB from the housing center line 16 to the second locking hole 312, is rendered greater than the distance LC from the housing center line 16 to the third locking hole 313, and it is possible to increase the distance between the plurality of elastic supporting members 330. Since there is a relationship "the vibration resistance torque of the rotary compressor 1=the magnitude of the force applied to the elastic supporting member 330×the distance between the elastic supporting members 330", it is possible to bear a vibration resistance torque which is greater by the amount by which the distance between the elastic supporting members 330 becomes greater. Accordingly, it is possible to reduce the vibration resistance torque which is borne by a discharge-side piping 108 and an inlet-side piping 256, and it is possible to prevent the piping stress from exceeding a permitted value and the discharge-side piping 108 and the inlet-side piping 256 breaking.

Since one location (the elastic supporting member 330 which is locked to the first locking hole 311) of a supporting point of the rotary compressor 1 is disposed in the vicinity of directly below the accumulator 25, the vertical vibration of the accumulator 25 is suppressed, and it is possible to suppress the vibration of the inlet-side piping 256 which is connected to the accumulator 25.

Since the housing base 310 is caused to overhang only in the direction that the accumulator 25 overhangs in relation to the compressor housing 10, it is possible to suppress the increase in installation space in which the rotary compressor 1 is installed on the outdoor unit to as small an amount as possible.

Example 2

Figure 4:
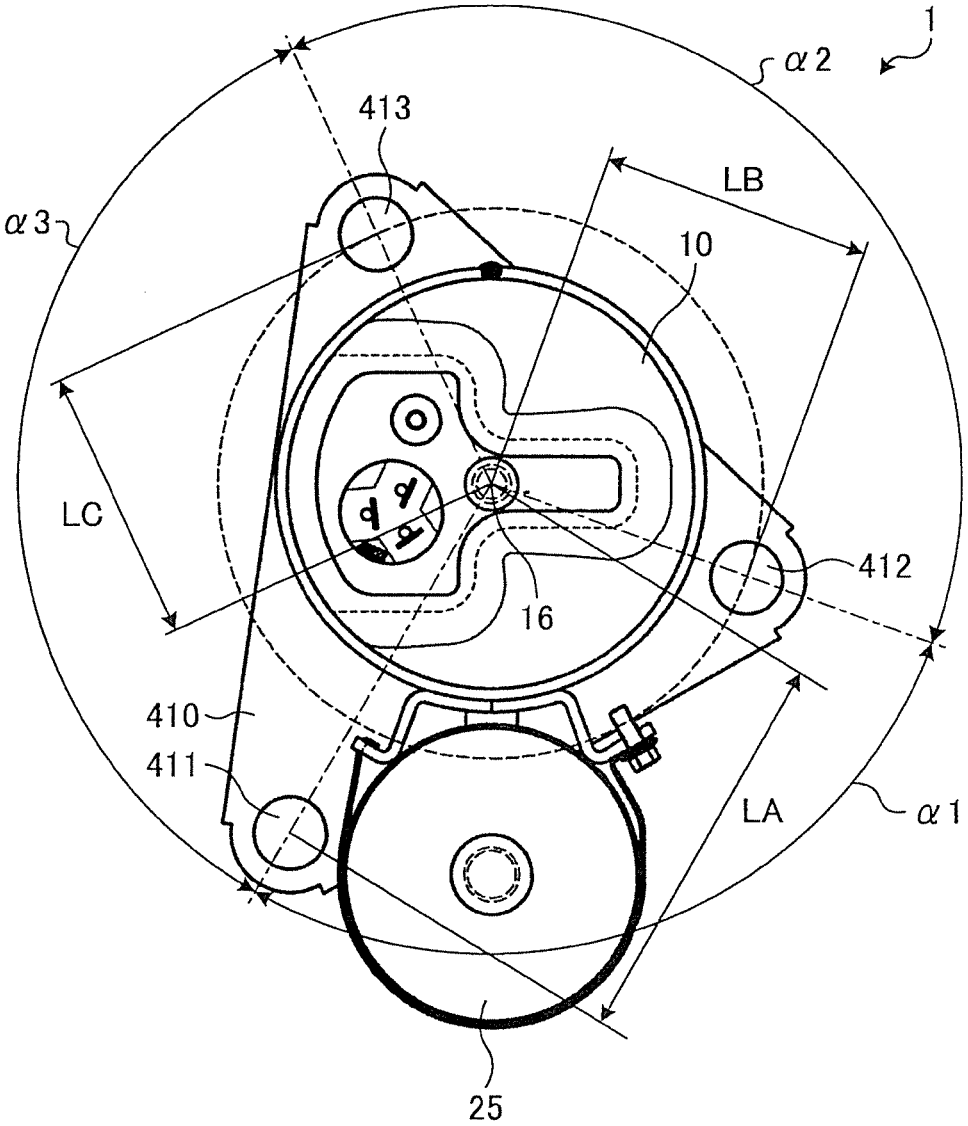
FIG. 4 is a top view illustrating example 2 of a rotary compressor according to the present invention.

Next, description will be given of the characteristic configuration of the rotary compressor 1 of example 2, with reference to FIGS. 1 and 4. FIG. 4 is a top view illustrating example 2 of the rotary compressor according to the present invention. As illustrated in FIGS. 1 and 4, in example 2, a triangular plate shaped housing base 410 which serves as the attachment legs is fixed to the bottom end of the compressor housing 10 so as to orthogonally intersect the housing center line 16. A first locking hole 411, a second locking hole 412, and a third locking hole 413 are provided in the housing base 410, one to each corner portion of the triangle shape. Instead of the triangular plate shaped housing base 410, three narrow, long, plate-shaped attachment legs (not illustrated) may be adopted as the attachment legs (410), one end of each being fixed to the bottom portion of the compressor housing 10, and each of the other ends extend radially to the position of a corresponding one of the first locking hole 411, the second locking hole 412, and the third locking hole 413.

In example 2, the distance LA from the housing center line 16 to the first locking hole 411 which is disposed closest to the accumulator 25, is greater than the distance LB from the housing center line 16 to the second locking hole 412, and the distance LA is greater than the distance LC from the housing center line 16 to the third locking hole 413. The pitch angle $\alpha 1$ between the first locking hole 411 and the second locking hole 412 which interposes the accumulator 25 between the first locking hole 411 and the second locking hole 412, is smaller than the pitch angle $\alpha 3$ between the first locking hole 411 and the third locking hole 413, and the pitch angle $\alpha 1$ is smaller than the pitch angle $\alpha 2$ between the second locking hole 412 and the third locking hole 413.

In the rotary compressor 1 of example 2, since the pitch angle $\alpha 1$ between the first locking hole 411 and the second locking hole 412 which interposes the accumulator 25 between the first locking hole 411 and the second locking hole 412, is smaller than the pitch angle $\alpha 3$ between the first locking hole 411 and the third locking hole 413, and the pitch angle $\alpha 1$ is smaller than the pitch angle $\alpha 2$ between the second locking hole 412 and the third locking hole 413, the position of the second locking hole 412 becomes closer to the accumulator 25. Accordingly, a large vibration force which would vibrate to the accumulator 25 side, is received by two elastic supporting members 330 which are locked to the first locking hole 411 and the second locking hole 412. As a result, the vertical vibration of the accumulator 25 is suppressed, and it is possible to further suppress the vibration of the inlet-side piping 256 which is connected to the accumulator 25.

It is possible to apply the present invention to a single cylinder system rotary compressor and a two-stage compression system rotary compressor.

In the above, description is given of the examples; however, the examples are not limited by the previously-described content. The previously-described constituent elements include elements which are essentially the same, and so-called elements of an equivalent scope. It is possible to combine the previously-described constituent elements, as appropriate. It is possible to perform at least one of various omissions, replacements, modifications, and any combination thereof of the constituent elements in a scope that does not depart from the gist of the examples.

What is claimed is:

1. A rotary compressor comprising:

a sealed vertically-placed cylindrical compressor housing which is provided with a discharge unit of a refrigerant on a top portion and which is provided with an inlet unit of the refrigerant on a bottom portion;

a rotary-type compressor unit which is disposed on the bottom portion of the compressor housing, compresses the refrigerant which is sucked in from the inlet portion, and discharges the refrigerant from the discharge unit;

a motor which is disposed on the top portion of the compressor housing and which drives the rotary-type compressor unit;

a vertically-placed cylindrical accumulator which is fixed to a side portion of the compressor housing and which is connected to the inlet portion; and an attachment leg having a triangular plate shape which is fixed to the bottom portion of the compressor housing and includes three locking holes which are locking holes to which three corresponding elastic supporting members, which support the compressor housing, are locked and which are disposed at each corner of the triangular plate shape to be separated from each other in a circumferential direction on an outside in a radial direction of the compressor housing, wherein, of the three locking holes, a distance of a first locking hole which is disposed closest to the accumulator from a housing center, is greater than a distance of each of the other two locking holes from the housing center, and a pitch angle around the housing center between the first locking hole and a second locking hole which interposes the accumulator between the first locking hole and the second locking hole, is smaller than a pitch angle around the housing center between the first locking hole and a third locking hole, and a pitch angle around the housing center between the second locking hole and the third locking hole.

2. The rotary compressor according to claim 1, wherein the first locking hole is disposed in a position no closer to an outside in the radial direction than the accumulator, and the first locking hole is disposed inward from a periphery of the accumulator disposed radially outward of the compressor.

3. The rotary compressor according to claim 1, wherein the first locking hole is disposed in a position which does not overlap the accumulator as viewed from above.

4. The rotary compressor according to claim 1, wherein a center of the accumulator is disposed outwardly of the attachment leg when viewed from a vertical direction of the compressor housing.

* * * * *